United States Patent [19]

Shea et al.

[11] Patent Number: 4,983,939

[45] Date of Patent: Jan. 8, 1991

[54] CIRCUIT BREAKER WITH ADJUSTABLE LOW MAGNETIC TRIP

[75] Inventors: John J. Shea, Monroeville; Richard P. Sabol, Munhall; Louis Paich, Center Township; Ronald A. Cheski, Stowe Township; Kenneth W. Sanner, Ohioville; William E. Beatty, Jr., Brighton Township, all of Pa.

[73] Assignee: Westinghouse Electric Corp., Pittsburgh, Pa.

[21] Appl. No.: 417,360

[22] Filed: Oct. 5, 1989

[51] Int. Cl.[5] ..... H01H 75/10

[52] U.S. Cl. ..... 335/42; 335/172; 335/176

[58] Field of Search ..... 335/42, 176, 45, 43.4, 335/8–10, 172

[56] References Cited

U.S. PATENT DOCUMENTS

| | | | |
|---|---|---|---|
| 4,249,151 | 2/1981 | Esteves | 335/42 |
| 4,249,152 | 2/1981 | Vazquez | 335/42 |
| 4,630,019 | 12/1986 | Maier et al. . | |
| 4,691,182 | 9/1987 | Mrenna et al. . | |

*Primary Examiner*—Leo P. Picard
*Assistant Examiner*—L. Donovan
*Attorney, Agent, or Firm*—M. J. Moran

[57] ABSTRACT

A circuit breaker has a magnetic trip assembly which can be adjusted to trip the breaker for low level overcurrents in the range of five to ten times rated current. The magnet trip includes for each pole of the breaker a helical torsion spring having one torsion arm which biases an armature against an adjusting bar to form a gap between the armature and a stationary magnetic structure in which magnetic flux strong enough to attract the armature and trip the breaker is induced by overcurrent. A second torsion arm of the spring has a first portion which bears against and slides along a pivot member carried by the adjusting bar to adjust the bias force applied to the armature by a given amount per unit travel of the adjusting bar over a low trip current portion of the range of travel of the adjusting bar. A second terminal portion of the second torsion arm of the spring extending at an angle from the first portion engages and slides along the pivot member on the adjusting bar to provide a greater change of bias force per unit travel of the adjusting bar at the higher trip current settings. Movement of the adjusting bar adjusts the spring bias for all poles of a multiphase circuit breaker simultaneously. The gaps between the armatures and the fixed magnetic structures of all the poles can also be adjusted by camming surfaces on the adjusting bar.

15 Claims, 7 Drawing Sheets

CIRCUIT BREAKER WITH ADJUSTABLE LOW MAGNETIC TRIP

BACKGROUND OF THE INVENTION

FIELD OF THE INVENTION

This invention relates to circuit breakers with a magnetic trip assembly including an armature which is biased by a spring to form a gap with a fixed magnetic structure and which is attracted toward the fixed magnetic structure to trip the breaker by magnetic flux produced by abnormal current. In particular, the invention relates to circuit breakers having such a trip assembly which includes mechanisms for adjusting the spring bias and the gap to modify the level of current at which the breaker trips.

BACKGROUND INFORMATION

Circuit breakers provide protection for electrical systems from electrical fault conditions such as current overloads and short circuits. Typically, circuit breakers include a spring powered, latchable operating mechanism which opens electrical contacts to interrupt the current through the conductors on an electrical system in response to abnormal currents. The operating mechanism is latched by a trip bar which in turn is operated by a trip mechanism associated with each phase of the electrical system. Typically, the trip mechanism includes a thermal trip device which responds to persistent low levels of overcurrent and a magntic trip device which responds instantaneously to higher levels of overcurrent. The magnetic trip device comprises for each pole a fixed magnetic structure energized by the current flowing through the conductor, and a moveable armature which is attracted toward the stationary magnetic structure to operate the trip bar. The trip bar in turn unlatches the operating mechanism which opens the electrical contacts in each phase of the electrical system. Each moveable armature is biased away from the associated stationary magnetic structure by a spring to form a gap between the armature and the stationary magnetic structure in the absence of a abnormal current.

Usually, means are provided for adjusting the level of current at which the magnetic trip device actuates the operating mechanism. Such adjustments can be made by varying the spring bias applied to the armature and/or by mechanically adjusting the gap such as by varying the position of a threaded screw or cam against which the spring biases the armature These adjustments permit fine tuning of the circuit breaker to assure that it will operate at the desired level of fault current. They can also be used to provide a range of settings at which the circuit breaker will trip.

U.S. Pat. No. 4,691,182 is an example of a circuit breaker having means for adjusting the spring bias and the gap for each pole of the breaker. The spring bias is adjusted individually for each pole by a rotatable cam which pivots a lever to adjust the bias applied to a rotatable armature by a tension spring. A threaded screw provides individual adjustment of the gap between the armature and the stationary magnetic structure.

U.S. Pat. No. 4,630,019 discloses a circuit breaker in which the armature of the magnetic trip device is biased by a helically wound torsion spring. The spring bias may be adjusted by engaging one arm of the torsion spring in one of a number of slots in a support plate.

For the most part, the above mentioned circuit breakers trip magnetically at currents which are about 15 to 20 times the rated currents of the breaker. Recently there has developed an interest for such circuit breakers with a trip assembly which operates at lower levels of instantaneous overcurrent. In particular, magnetic trips at about 5 to 10 times the rated current of the breaker are desired. While the above aforementioned circuit breakers provide good adjustability within their operating ranges, they cannot for the most part be adjusted to operate effectively at the desired lower tripping levels of 5 to 10 times breaker rating. The major obstacles are insufficient force to trip the breaker at the required low current levels, limited magnetic trip range due to space limitations on adjusting bar movement, and tolerances. However, such circuit breakers have been in use for many years and their design has been refined to provide an effective, reliable circuit breaker which can be easily and economically manufactured on a large scale.

There is a need therefore for circuit breakers which can reliably operate at low magnetic trip currents.

There is a related need for modifying existing proven circuit breaker designs to operate at the new lower magnetic tripping current levels.

There is a further need for such modifications which require minimum changes to the existing circuit breakers, and which can be easily and economically applied.

SUMMARY OF THE INVENTION

These and other needs are satisfied by the invention which is directed to a circuit breaker with a magnetic trip assembly which includes a spring applying a biasing force to the armature to bias it away from the fixed magnetic structure and spring adjustment means moveable over a range of travel for adjusting the biasing force to modify the value of abnormal current at which the armature is attracted to the fixed magnetic structure to unlatch the circuit breaker latchable operating mechanism. The spring adjusting means provides a first relationship between movement of the spring adjusting means and change in the biasing force over a first portion of the range of travel of the adjusting means, and provides a second relationship between movement of the spring adjusting means and change in the biasing force over a second portion of the range of travel of the spring adjusting means. The spring adjusting means adjusts the biasing force in this manner simultaneously for all three poles.

More particularly, the spring is a torsion spring having a first torsion arm which bears against and applies the bias force to the armature, and a second torsion arm having a first portion and a second terminal portion extending at an angle to the first portion. The spring adjusting means comprise's a pivot member which is mounted for reciprocal movement over the range of travel of the adjusting means. The first portion of the second torsion arm engages and slides along the pivot member for the first portion of the range of travel of the spring adjusting means and the second terminal portion of the second torsion arm engages and slides along the pivot member for the second portion of the range of travel of the spring adjusting means. The angle which the second portion of the second torsion arm makes with an adjustment axis along which the pivot member reciprocates is greater than the angle that the first portion of the second torsion arm makes with this adjustment axis so that movement of the adjusting means over the second portion of its range of travel produces a greater change in the bias force per unit travel than does movement of the adjusting member over the first portion of its range of travel. This Provides the greater relative change required for adjusting the trip current from between about five and ten times the circuit breaker rating as compared with adjusting the range between 15 and 20 times the breaker rating.

As another aspect of the invention, the adjustment bar carries means for adjusting the gap between the armature and the fixed magnetic structure. In one embodiment cams are provided on the adjusting bar against which the armatures are biased by the springs. Rectilinear movement of the adjusting bar adjusts the portion of the camming surface of the cam against which the armature bears and therefore varies the gap. Alternatively, a camming surface can be provided on the armature as by twisting a tab on a planar armature. A projection on the adjusting bar moves along the camming surface to adjust the gap. Preferably, the projection is a screw so that gap may be set independently for each pole. Also preferably, the second portion of the second torsion of the biasing spring engages the pivot member when the gap is at the high end of its range.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
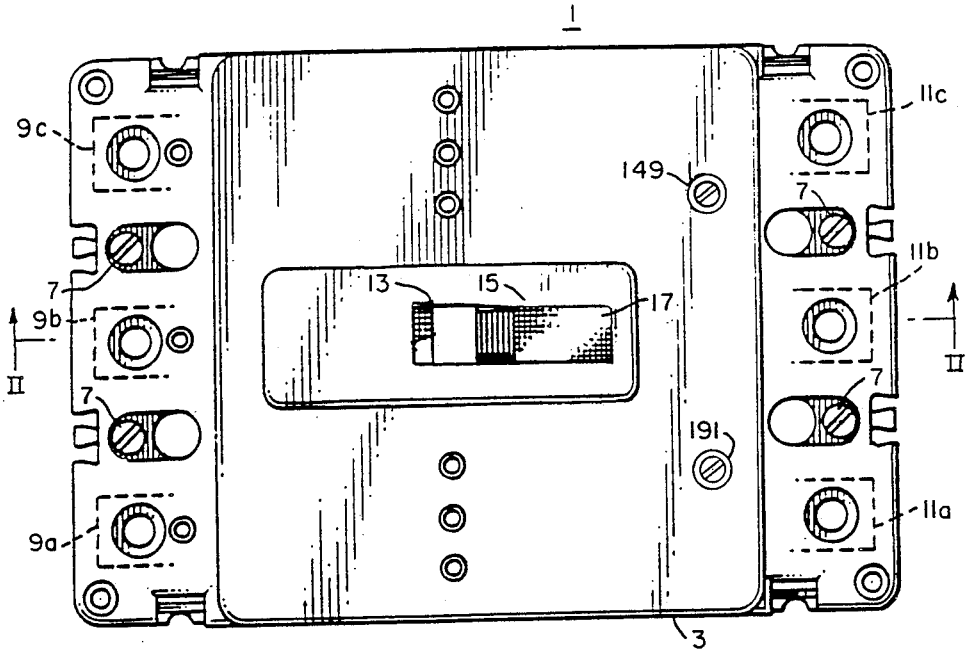
FIG. 1 is a plan view of a circuit breaker incorporating the invention.

Referring to the drawings, there is illustrated a molded case circuit breaker 1 incorporating a magnetic trip assembly with the improved means for adjusting the trip set point in accordance with the teachings of the invention. While the circuit breaker 1 is depicted and described herein as a three-phase, or three-pole circuit breaker, the principles of the invention are equally applicable to single phase or polyphase circuit breakers, and to both ac and dc circuit breakers.

The circuit breaker 1 includes a molded, electrically insulting, top cover 3 mechanically secured to a molded, electrically insulating, bottom cover or base 5 by fasteners 7. A set of first electrical terminals, or line terminals *9a*, *9b* and *9c* are provided, one for each pole or phase. Similarly, a set of second electrical terminals, or load terminals *11a*, *11b* and *11c* are provided at the other end of the circuit breaker base 5. These terminals are used to serially electrically connect circuit breaker 1 into a three-phase electrical circuit for protecting a three-phase electrical system.

Figure 2:
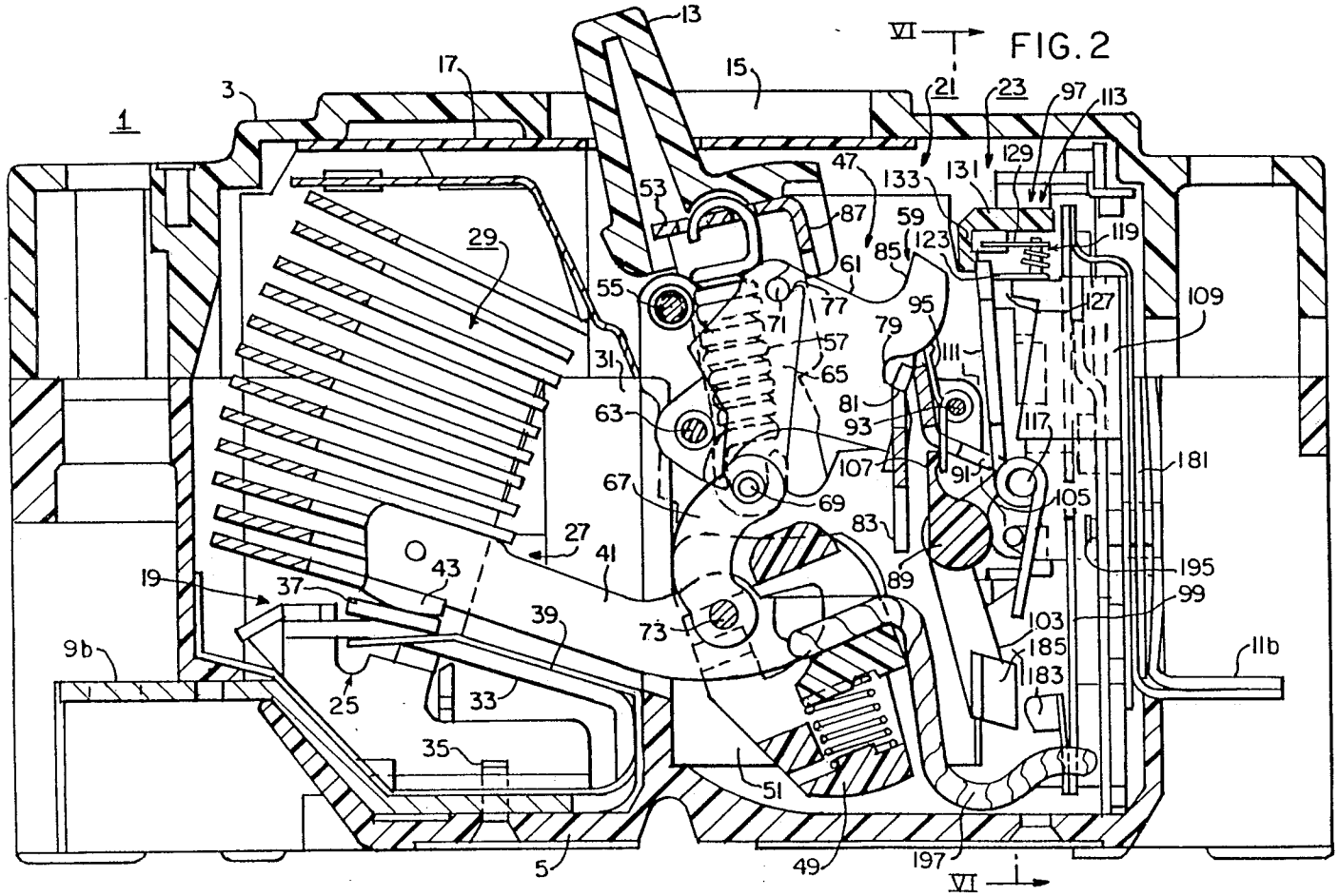
FIG. 2 is an enlarged vertical section through the circuit breaker of FIG. 1 taken along the line to 2 in FIG. 1 and illustrating the circuit breaker in the closed position with the blown open position shown in phantom.
Figure 4:
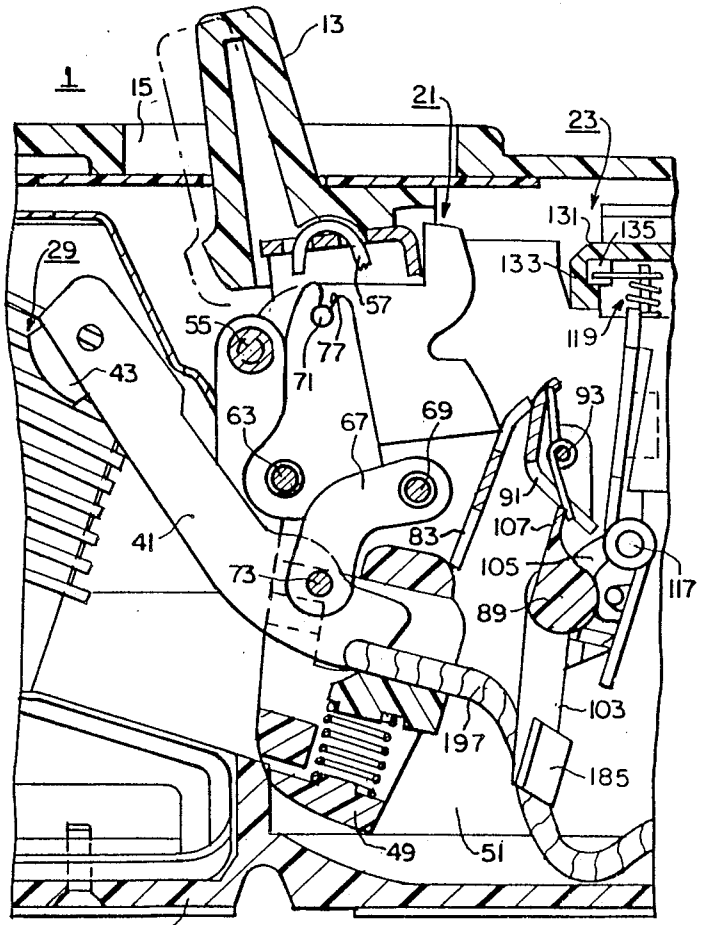
FIG. 4 is an enlarged vertical section of a portion the circuit breaker of FIG. 1 taken along the same line as FIGS. 2 and 3 but showing the circuit breaker in the tripped position.
Figure 3:
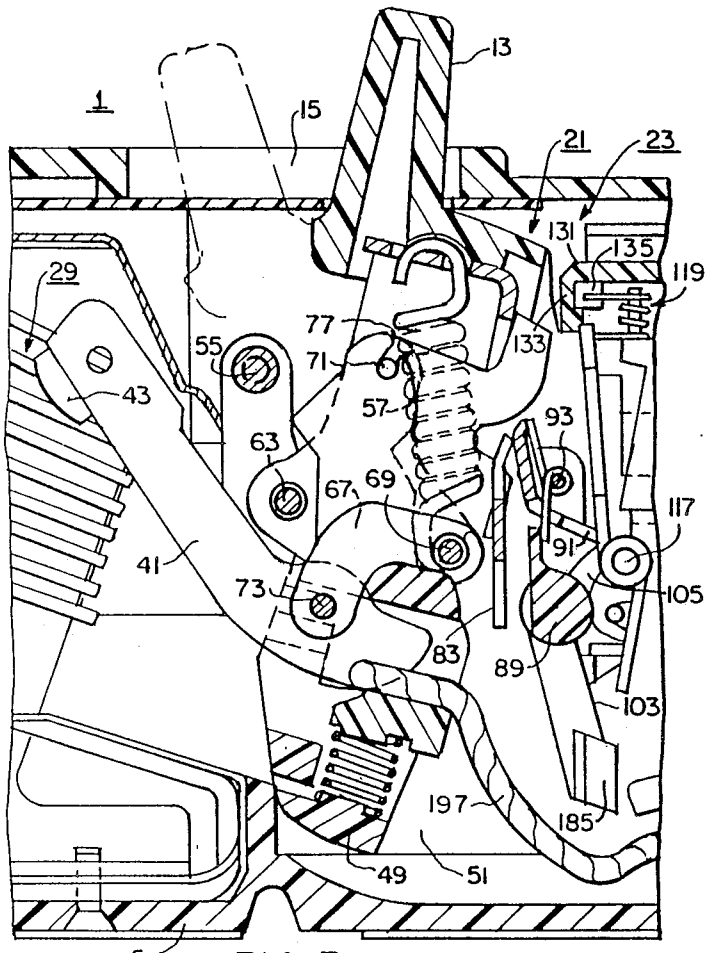
FIG. 3 is an enlarged vertical section of a portion of the circuit breaker of FIG. 1 taken along the same line as FIG. 2 but showing the circuit breaker in the open position.

The circuit breaker 1 further includes an electrically insulating, rigid, manually engagable handle 13 extending through an opening 15 in the top cover 3 for setting the circuit breaker 1 to its CLOSED position (FIG. 2 or its OPEN position (FIG. 3). The circuit breaker 1 may also assume a TRIPPED position (FIG. 4). Circuit breaker 1 may be reset from the TRIPPED position to the CLOSED position for further protective operation by moving the handle 13 through the open position (FIG. 3). The handle 13 may be moved either manually or automatically by an operating mechanism 21 to be described in more detail. Preferably, an electrically insulating strip 17, movable with the handle 13, covers the bottom of the opening 15, and serves as an electrical barrier between the interior and the exterior of the circuit breaker 1.

As its major internal components, the circuit breaker 1 includes a set of electrical contacts 19 for each phase, an operating mechanism 21 and a trip mechanism 23. Each set of electrical contacts includes a lower electrical contact 25 and an upper electrical contact 27. Associated with each set of electrical contacts 19 are an arc chute 29 and a slot motor 31 both of which are conventional. Briefly, the arc chute 29 divides a single electrical arc formed between separating electrical contacts 25 and 27 upon a fault condition into a series of electrical arcs, increasing the total arc voltage and resulting in a limiting of the magnitude of the fault current. The slot motor 31, consisting of either of a series of generally U-shaped steel laminations encased in electrical insulation or of a generally U-shaped electrically insulated, solid steel bar, is disposed about the contacts 25, 27, to concentrate the magnetic field generated upon a high level short circuit or fault current condition thereby greatly increasing the magnetic repulsion forces between the separating electrical contacts 25 and 27 to rapidly accelerate their separation. The rapid separation of the electrical contracts 25 and 27 results in a relativelyhigh arc resistance to limit the magnitude of the fault current. A more detailed description of the arc chute 29 and slot motor 31 can be found in U.S. Pat. No. 3,815,059.

The lower electrical contact 25 includes a U-shaped stationary member 33 secured to the base 5 by a fastener 35, a contact 37 for physically and electrically contacting the upper electrical contact 27 and an electrically insulating strip 39 to reduce the possibility of arcing between the upper electrical contact 27 and portions of the lower electrical contact 25. The line terminal 9 extending exteriorly of the base 5 comprises an integral end portion of the member 33.

The upper electrical contact 27 includes a rotatable contact arm 41 and a contact 43 for physically and electrically contacting the lower electrical contact 25.

The operating mechanism 21 includes an over-center toggle mechanism 47, an integral one-piece molded cross bar 49, a pair a rigid, spaced apart, metal side plates 51, a rigid, pivotable metal handle yoke 53, a rigid stop pin 55, a pair of operating tension springs 57 and a latching mechanism 59.

The over-center toggle mechanism 47 includes a rigid, metal cradle 61 that is rotatable about the longitudinal central axis of a cradle support pin 63 journaled in the side plates 51.

The toggle mechanism 47 further includes a pair of upper toggle links 65, a pair of lower toggle links 67, a toggle spring pin 69 and an upper toggle link follower pin 71. The lower toggle links 67 are secured to either side of the rotatable contact arm 41 of the upper electrical contact 27 by toggle contact pin 73. The ends of the pin 73 are received and retained in the molded cross bar 49. Thus, movement of the upper electrical contact 27, and the corresponding movement of the cross bar 49 are effected by movement of the lower toggle links 67. In this manner, movement of the upper electrical contact 27 by the operating mechanism 21 in the center pole or phase of the circuit breaker 1 simultaneously, through the rigid cross bar 49, causes the same movement in the electrical contacts 27 associated with the other poles or phases of the circuit breaker 1.

The upper toggle links 65 and lower toggle links 67 are pivotally connected by the toggle spring pins 69. The operating tension springs 57 are stretched between the toggle spring pin 69 and the handle yoke 53 such that the springs 57 remain under tension, enabling the operation of the over-center toggle mechanism 47 to be controlled by and be responsive to external movement of the handle 13.

The upper links 65 also include recesses or grooves 77 for receipt and retention of pin 71. Pin 71 passes through the cradle 61 at a location spaced by a predetermined distance from the axis of rotation of the cradle 61. Spring tension from the springs 57 retains the pin 71 in engagement with the upper toggle links 65. Thus, rotational movement of the cradle 61 effects a corresponding movement or displacement of the upper portions of the links 65.

The cradle 61 has a slot or groove 79 defining a flat latch surface which is configured to engage a flat cradle latch surface formed in the upper end of an elongated slot or aperture 81 in a generally flat intermediate latch plate 83. The cradle 61 also includes a generally flat handle yoke contacting surface 85 configured to contact a downwardly depending, elongated surface 87 formed on the upper end of the handle yoke 53. The operating springs 57 move the handle 13 during a trip operation and the surfaces 85 and 87 locate the handle 13 in the TRIPPED position (FIG. 4) intermediate the CLOSED position (FIG. 2) and the OPEN position (FIG. 3) of the handle 13, to indicate that the circuit breaker 1 has tripped. In addition, the engagement of the surfaces 85 and 87 resets the operating mechanism 21 subsequent to a trip operation by moving the cradle 61 in a clockwise direction against the bias of the operating springs 57 from its TRIPPED position (FIG. 4) to and past its OPEN position (FIG. 3) to enable the relatching of the latching surfaces on groove 79 and in aperture 81.

Further details of the operating mechanism and its associated molded cross bar 49 can be gained from the description of the similar operating mechanism disclosed in U.S. Pat. No. 4,630,019.

The trip mechanism 23 includes the intermediate latch plate 83, a molded one-piece trip bar 89, a cradle latch plate 91, a torsion spring support pin 93, a double acting torsion spring 95, a magnetic trip assembly 97 and a thermal trip device 99 in the form of a bimetal.

The molded one-piece trip bar 89 is journaled in vertical partitions 101 in the base 5 of the molded case circuit breaker 1 which separate the three poles of the circuit breaker. (See FIG. 6.) The trip bar 89 has actuating levers 103 for each pole extending radially downward. (See also FIGS. 2–4.) A trip lever 105 extending outwardly from the trip bar is engaged by the cradle latch plate 91 Cradle latch plate 91 is mounted for rotation about an axis parallel to the trip bar. One arm of the double acting torsion spring 95 biases the cradle latch plate 91 against the intermediate latch plate 83. The other arm of the torsion spring 95 bears against a vertical projection 107 on the trip bar 89 to bias the trip bar in the counter clockwise direction as viewed in FIG. 2.

With the circuit breaker in the CLOSED position as shown in FIG. 2, the tension springs 57 tend to rotate the cradle 61 in the counter clockwise direction. This is resisted, however, by the cradle latch plate 91 held in place by the trip lever 105 on the trip bar 89 and acting through the intermediate latch plate 83.

The magnetic trip assembly 97 includes a stationary magnetic structure 109, an armature 111, and a mechanism 113 for adjusting the magnetic trip. The planar armature 111 is bent along a horizontal axis and slotted at 115 for receipt of a pin 117 about which the armature is rotatable.

The adjusting mechanism 113 includes a helical torsion spring 119 supported on a vertical projection 121 (see FIG. 5) of the stationary magnetic structure 109. The torsion spring 119 has one spring arm 123 which bears against an upwardly projecting tongue 125 on the armature 111 to bias the armature away from the stationary magnetic structure 109 to form a gap 127 therebetween. The other spring arm 129 of the spring 119 is engaged by an adjusting bar 131. The adjusting bar 131 includes a depending flange 133 against which the arm 123 of the torsion spring 119 biases the tongue 125 on the armature 111. The upper spring arms 129 of the torsion springs 119 are engaged by pivot members 135 molded into the adjusting bar 131.

Figure 7:
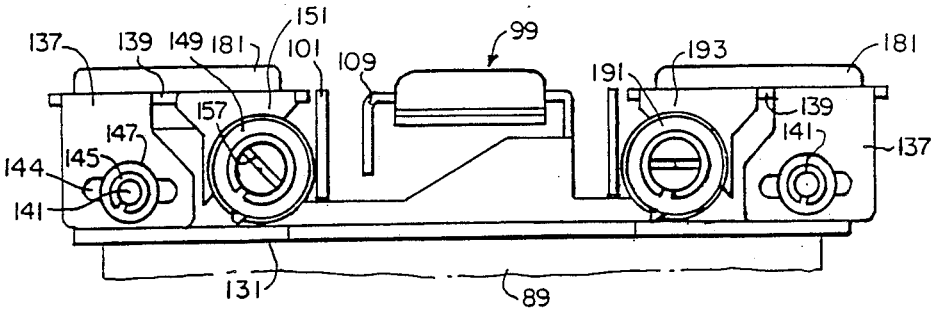
FIG. 7 is a plan view of the portion of the circuit breaker shown in FIG. 6.
Figure 6:
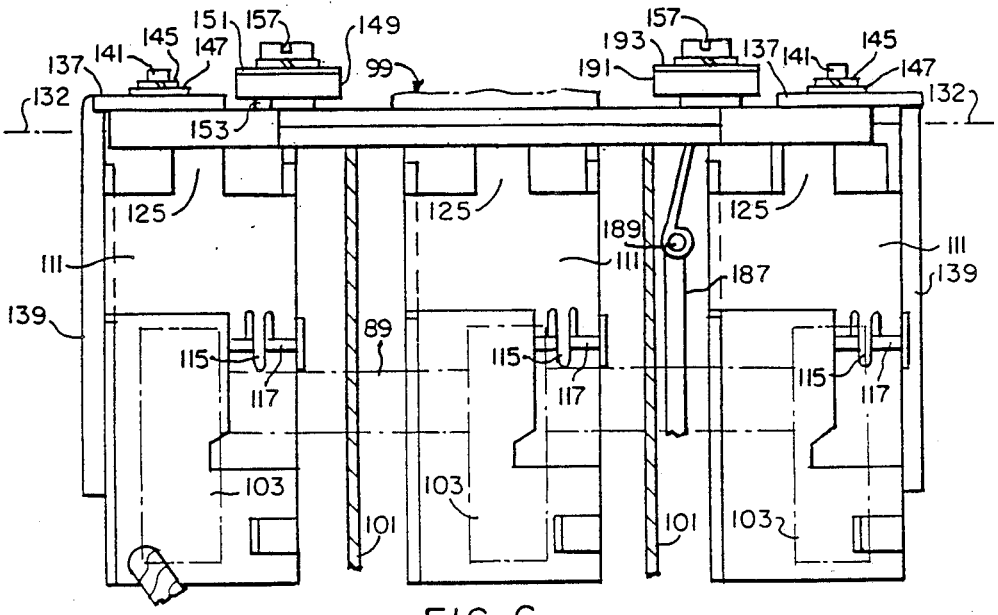
FIG. 6 is a vertical cross section through the circuit breaker of the invention taken along the line 6—6 in FIG. 1.
Figure 8:
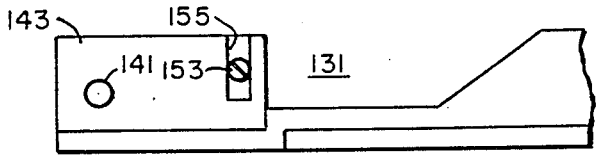
FIG. 8 is a fragmentary view of a portion of FIG. 7 with parts removed.

The adjusting bar 131 is supported for rectilinear, longitudinal movement by first horizontal ledges 137 on brackets 139 (see FIGS. 6–8). Upstanding pins 141 on enlarged portions 143 at each end of the adjusting bar 131 extend upward through elongated slots 144 in the ledges 137 (see FIG. 7).

Snap rings 145 received in grooves (not shown) in the pins 141 slidably connect the adjusting bar 131 to the bracket ledges 137. Washers 147 are provided between the snap rings 145 and the ledges 137.

A rotatably camming mechanism 149 mounted on a second raised ledge 151 on the bracket 139 adjacent one end of the adjusting bar 131 has an eccentric, depending pin 153 which engages a transverse groove 155 in the enlarged end 143 of the adjusting bar 131 (see FIG. 8). Rotation of the camming device 149 by insertion of a tool such as a screw driver into a slot 157 provides the capability of rectilinearly moving the adjusting bar longitudinally along an adjustment axis 13 (see FIG. 6). As can be seen from FIG. 1, the rotatable camming device 149 is accessible through the cover 3 on the circuit breaker 1 to provide means for adjusting the position of the adjusting bar 131 without removing the cover Since the spring arms 129 of the torsion springs 119 biasing the armatures 111 of all of the poles are engaged by pivot members 135 in the adjusting bar 131, the bias on the armature 111 for each pole can be adjusted simultaneously by rotating the rotatable camming device 149.

Figure 5:
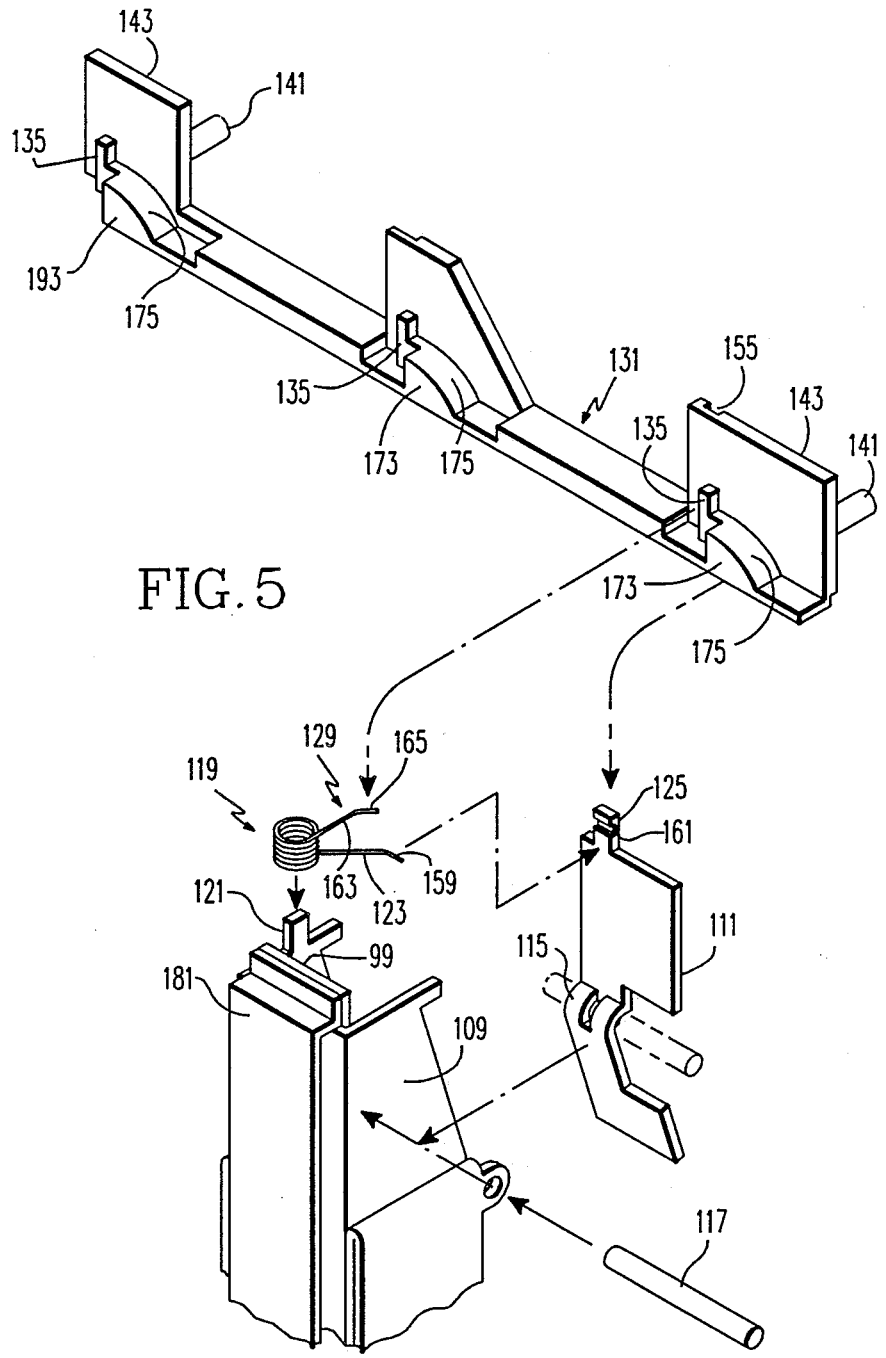
FIG. 5 is an exploded isometric view of a magnetic trip assembly in accordance with the invention.

The details of the arrangement for adjustment of the torsion spring bias can best be understood by reference to FIGS. 5, 9A and 9B, 10A through 10D, and 11. FIG. 5 is an exploded isometric view in which the adjusting bar 131 has been rotated 90 degrees clockwise to show the configuration of the underside. The one torsion arm 123 of the torsion spring 119 has a terminal portion 159 which is bent at an angle to the main portion of the arm for engaging a groove 161 in the tongue 125 of the armature 111.

Figure 9A:
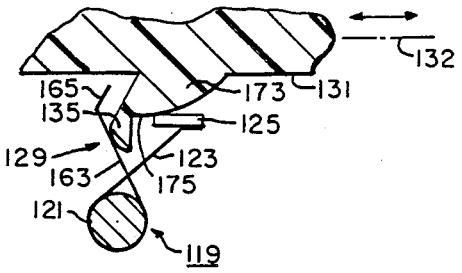
FIGS. 9A and 9B are partial horizontal sections showing engagement of a spring with an armature and with the adjustment bar for a low setting and a high setting of the circuit breaker of FIG. 1 respectively.
Figure 9B:
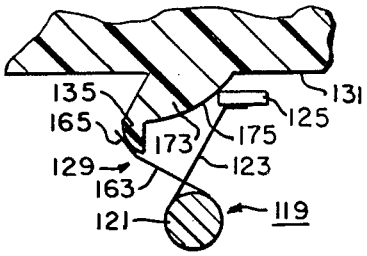

The second torsion arm 129 of the torsion springs 119 has a first portion 163 and a second terminal portion 165 which extends at an angle from the portion 163. As can be seen from FIGS. 9A and 9B, the second torsion arm 129 of torsion spring 19 bears against the pivot member 135 integrally molded into the adjusting bar 131. With the adjustment bar in the position shown in FIG. 9a, the first portion 163 of the torsion arm 129 bears against the pivot member 135. This is for low settings of trip current. It can be appreciated that as the adjusting bar 131 moves rectilinearly along the adjustment axis 132 that the arm 129 of the torsion spring 119 is deflected to the left as shown in FIG. 9A or follows the pivot member 135 as the adjusting bar moves to the right. Movement of the adjusting bar to the left as viewed in FIG. 9A results in an increase in the bias force applied to the armature through the tongue 125. It can also be appreciated that as the adjusting bar 131 moves to the left and the post 121 on which the spring 119 is mounted remains stationary and offset laterally from the pivot member 135, the second torsion arm 129 slides along the pivot member 135. A point is reached where the second terminal portion 165 of the second torsion arm 129 comes into contact with the pivot member 135 as shown in FIG. 9B. Due to the angle between the portions 163 and 165 of the torsion arm 129, engagement of the pivot member by the terminal portion 165 results in a greater change in the bias force applied to the armature per unit travel of the adjusting arm than when the portion 163 of the arm 129 rides on the pivot member 135. This action can be more clearly seen from FIG. 10A through 10D.

Figure 10A:
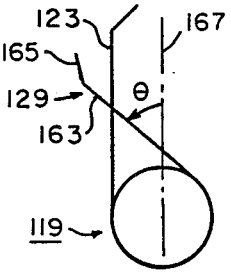
FIGS. 10A, 10B, 10C, and 10D illustrate schematically a spring used in a circuit breaker of the invention in the free position, a low setting position, an intermediate setting position, and a high setting position, respectively.
Figure 10B:
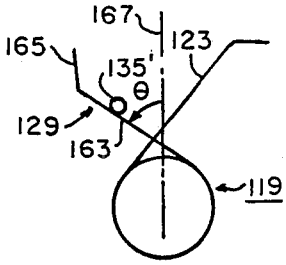
Figure 10C:
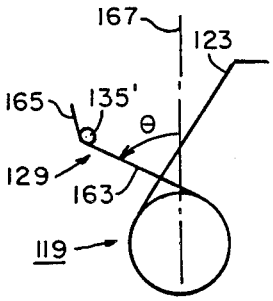
Figure 10D:
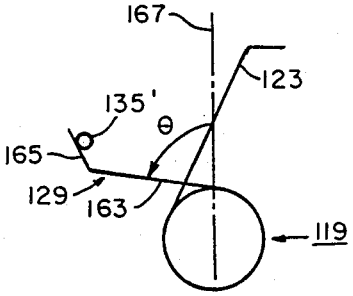

FIG. 10A illustrates the free position of the spring 119 in which neither arm 123 nor arm 129 is engaged. With no load applied to the spring, the angle $\theta$ between the axis 167 and the second torsion arm 129 is, in the exemplary embodiment, about 50 degrees. FIG. 10B illustrates the low trip current condition where the arm 123 is engaged by the armature and the first portion 161 of the second arm 129 is engaged by the pivot member represented by the pin 135'. Under these conditions, the angle $\theta$ is about 55 degrees. FIG. 10C illustrates the condition of the spring for intermediate settings of trip current. In this Figure, contact between the second arm 129 of the torsion spring 119 and the pivot member 135' is about to transfer from the first portion 163 to the second portion 165. For intermediate settings, the angle $\theta$ varies from 55 degrees up to about 88 degrees. Finally, FIG. 10D illustrates the maximum trip current condition where the pivot member 135' has slid to near the end of the second portion 165 of the second arm 129 of the spring. In the exemplary embodiment, this occurs at a $\theta$ of around 88 degrees.

Figure 11:
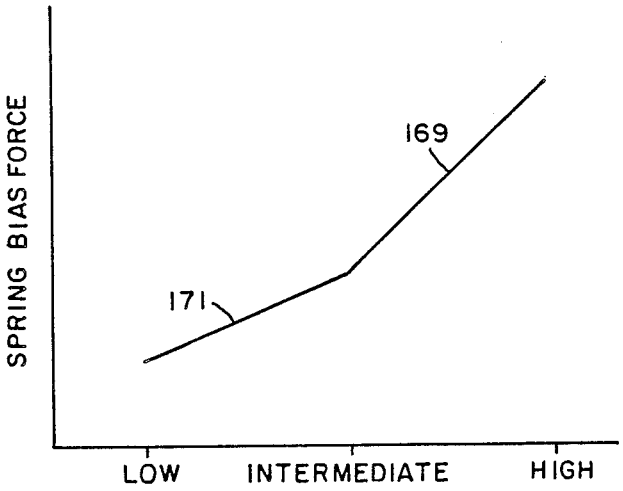
FIG. 11 is a plot of bias force versus adjustment bar movement for the spring shown in FIGS. 9 and 10.

The effect of this bend in the second torsion arm 129 of the spring 119 is illustrated in FIG. 11 which plots a spring bias force generated versus adjusting bar position. As can be seen, the slope of the plot in the section 169 where the terminal end 165 of the second torsion arm 129 is in contact with the pivot member 135 is steeper than the portion 175 representing the condition where the first portion 163 of the torsion arm 129 is contact with the pivot member 135. Is illustrated in FIG. 11, the bias force with the terminal portion 165 in contact with the pivot member 135 is not only greater but changes at a greater rate with movement of the adjusting bar. This characteristic allows the circuit breaker of the invention to vary the trip current over a greater relative range than prior art circuit breakers.

In addition to varying the spring bias force applied to the armatures, the circuit breaker of the invention also adjusts the gap 127 between the armature and the fixed magnetic structure 109. In accordance with one embodiment of the invention shown in FIGS. 5 and 9A and 9B, cams 173 are provided on the adjusting bar 131. These cams 173 have camming surfaces 175 against which the tongue 125 of the armatures 111 are biased by the torsion arm 123 of the torsion spring 119. As will be evident from FIGS. 9A and 9B, rectilinear movement of the adjusting bar 131 along the adjusting axis 132 results in a change in the biased position of the armature, and hence the gap between the armature and the fixed magnetic structure. In the preferred embodiment of the invention, as shown, the profile of the camming surfaces 175 are selected and positioned relative to the pivot member 135 such that as the gap increases, the spring bias force also increases. Therefore, the greatest spring bias force is applied at the maximum gap opening, and conversely minimum spring bias is applied at the minimum gap opening. The additive effect of the adjustment of the spring bias and the gap width provide a wide dynamic range for setting of trip current which permits the circuit breaker to be set for a magnetic trip anywhere between about five and ten times the rated current of the breaker.

Figure 12:
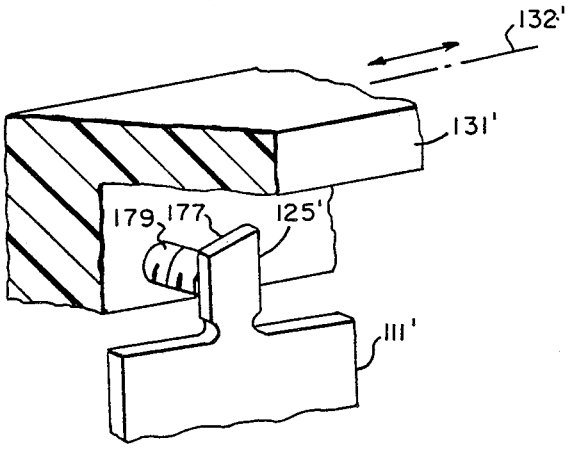
FIG. 12 is a horizontal section through a portion of another embodiment of a circuit breaker in accordance with the invention.

FIG. 12 illustrates an alternative embodiment of the circuit breaker 1 in accordance in the invention illustrating a modified arrangement for adjusting the gap 127 between the armatures and the fixed magnetic structures. In this arrangement, the tongue 125' is twisted with respect to the planar main body of the armature 111' to form a camming surface 177. A set screw 179 projects from the adjusting bar 131 and bears against the camming surface 177 so that movement of the adjusting bar 131' along the adjustment axis 132' results in adjustment of the gap. Such movement of the adjusting bar results in simultaneous adjustment of the gap for each pole, however, with the arrangement of FIG. 12, the actual gap at any setting of the adjusting bar can be individually set by separate adjustment of the associated adjustment screw 179.

The thermal trip for the circuit breaker 1 is set by bimetal 99 which is electrically connected to the load terminal 11*b* through a conductive member 181. The lower end of the bimetal 99 is provided with a finger 183 which is spaced from a beveled surface 185 on the lower end of the actuating arm 103 on the trip bar 89. The bevelled surface 185 defines a plane having the left edge as viewed in FIG. 3 closer than the right edge. Adjustment of the spacing between the finger 183 and surface 185 can be accomplished by two means. A lever arm 187 pivoted for rotation about a pin 189 engages the trip bar 89 at its lower end as seen in FIG. 6. The upper end of the lever arm 187 is engaged by a rotatable camming device 191 mounted on a ledge 193 on the bracket 139. The camming device 191 is similar to the device 149. Rotation of the camming device 191 causes the lever arm 187 to rotate sliding the trip bar 89 axially. Due to the bevelled surface 185 on the actuating lever 103, spacing between the bimetal 99 and the trip bar 89 is adjusted. The camming device 191 is also accessible through the top cover of the circuit breaker 1 as shown in FIG. 1. Calibration of the bimetal can be effected at the factory through rotation of a screw 195.

A current bearing conductive path between the lower end of the bimetal 99 and the upper electrical contact 27 is achieved by a flexible copper shunt 197 connected by any suitable means, for example by braising, to the lower end of the bimetal 99 and to the upper electrical contact 27 within the cross bar 49. In this manner, an electrical path is provided through the circuit breaker 1 between the terminals 9B and 11*b* via the lower electrical contact 25, the upper electrical contact 27, the flexible shunt 197, the bimetal 99, and the conductive member 181.

Adjustment of the camming device 191 varies the response time of the circuit breaker to low level over currents. Since the bimetal is surrounded by the stationary magnetic structure 109, the current conducted by the bimetal generates a magnetic field in the stationary magnetic structure which attracts the armature 111. The spring bias and gap set by adjustment of the adjusting bar 131 through rotation of the camming device 149 adjust the level of current at which the armature is attracted to the stationary magnetic structure for the magnetic trip.

In operation, the circuit breaker 1 is set to the closed position as shown in FIG. 2. A current in at least one of the poles which exceeds the magnetic trip setting established by the spring bias through the camming device 149, and, if provided, the adjusting screw 179, generates a magnetic field in the stationary magnetic structure 109 sufficient to pull the armature 111 in the associated pole toward it in a clockwise direction as viewed in FIG. 2. The lower end of the armature rotates the trip bar in the clockwise direction until the cradle latch plate 91 slides off of the trip lever 105. This unlatches the cradle 61 permitting the operating tension springs 57 to rotate the cradle 61 counter-clockwise as viewed in FIG. 2 which causes the toggle mechanism 47 to break over to the position shown in FIG. 3 thereby opening the set of electrical contacts 19. As previously mentioned, this results in rotation of the cross bar 49 which opens the sets of contacts 19 on each of the poles of the circuit breaker 1.

A persistent low level current causes the bimetal 99 to bend bringing the finger 183 into contact with the camming surface 185 or the trip lever 105 on the trip bar 89 thereby rotating the trip bar 89 and tripping the circuit breaker in the manner discussed above in connection with the magnetic trip.

With the circuit breaker tripped, the contacts are opened as shown in FIG. 4. The circuit breaker 1 is reset by moving the handle 13 to the OFF position as shown in FIG. 3. This rotates the cradle 61 to a position where the cradle latch plate 91 biased by the latch torsion spring 95 urges the intermediate latch plate 83 into engagement with the latching surface of the groove 79 in the cradle 61. The latch torsion spring 95 also rotates the trip bar counter-clockwise until the cradle latch plate 91 is engaged and retained in a latched position by the lever 105 on the trip bar 89 as shown in FIG. 5. The trip mechanism 23 is thus relatched and ready for closing of the circuit breaker by movement of the handle 13 to the CLOSED position shown in FIG. 2. This causes the toggle mechanism 47 to rotate counter-clockwise over center, thereby closing the sets of electrical contacts 19 for each pole.

If it is desired to adjust the instantaneous trip set point of the circuit breaker 1, a screw driver or other tool is inserted in the rotatable camming device 149 and rotated to move the adjusting bar 131 in a desired direction, the required amount. If it is desired to adjust the trip delay, a tool is inserted in the camming device 191 and rotated to pivot the lever arm 187 thereby axially displacing the trip bar 89 to adjust the gap between the finger 183 on the bimetal 99 and the beveled surface 185 on the actuating arm 103 of the trip bar 89.

While specific embodiments of the invention have been described in detail, it will be appreciated by those skilled in the at that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A circuit breaker for responding to abnormal currents in a conductor in an electrical system, comprising:

electrical contacts operable between a closed position in which a circuit is completed through the conductor and an open position in which the circuit through the conductor is interrupted;

a latchable operating mechanism operable to open said electrical contacts when unlatched;

a magnetic trip assembly comprising:

a stationary magnetic structure in which a magnetic flux is produced by current in said conductor passing through said electrical contacts;

a movable armature which is attracted to the stationary magnetic structure by said magnetic flux produced by an abnormal current of a selected value through said electrical contacts to unlatch said latchable operating mechanism and open said electrical contacts;

spring means applying a spring biasing force to said armature to bias said armature away from said stationary magnetic structure to form a gap therewith; and spring adjusting means movable over a range of travel adjusting said biasing force to modify the selected value of abnormal current at which said armature is attracted to the fixed magnetic structure to unlatch the latchable operating mechanism, said spring adjusting means providing a first relationship between a predetermined increment of movement of the spring adjusting means and change in said biasing force over a first portion of said range of travel of the spring adjusting means and providing a second relationship between said predetermined increment of movement of the spring adjusting means and change in said biasing force over a second portion of the range of travel of said spring adjusting means, said first and second relationship being different.

2. A circuit breaker for responding to abnormal currents in a conductor in an electrical system, comprising:

electrical contacts operable between a closed position in which a circuit is completed through the conductor and an open position in which the circuit through the conductor is interrupted;

a latchable operating mechanism operable to open said electrical contacts when unlatched;

a magnetic trip assembly comprising:

a stationary magnetic structure in which a magnetic flux is produced by current in said conductor passing through said electrical contacts;

a movable armature which is attracted to the stationary magnetic structure by said magnetic flux produced by an abnormal current of a selected value through said electrical contacts to unlatch said latchable operating mechanism and open said electrical contacts;

spring means applying a spring biasing force to said armature to bias said armature away from said stationary magnetic structure to form a gap therewith;

spring adjusting means movable over a range of travel adjusting said biasing force to modify the selected value of abnormal current at which said armature is attracted to the fixed magnetic structure to unlatch the latchable operating mechanism, said spring adjusting means providing a first relationship between a movement of the spring adjusting means and change in said biasing force over a first portion of a said range of travel of the spring adjusting means and providing a second relationship between movement of the spring adjusting means and change in said biasing force over a second portion of the range of travel of said spring adjusting means; and said spring means comprising, a torsion spring having a first torsion arm which bears against and applies said bias force to said armature, and a second torsion arm having a first portion and a second terminal portion extending at an angle to the first terminal portion, and wherein said spring adjusting means comprises a pivot member and means mounting said pivot member for reciprocal movement over said range of travel, said second torsion arm engaging and sliding along said pivot member as said pivot member reciprocates with the first portion of said second torsion arm engaging and sliding along said pivot member for the first portion of said range of travel of the spring adjusting means and with said second terminal portion of said second torsion arm engaging and sliding along said pivot member for the second portion of said range of travel of said spring adjusting means.

3. The circuit breaker of claim 2 wherein said mounting means mounts said pivot member for rectilinear reciprocal movement along an adjustment axis, wherein the first portion of the second torsion arm of said torsion spring forms a first angle with the adjustment axis of the pivot member when in engagement with said pivot member and wherein the second portion of the second torsion arm of said torsion spring forms a second angle with said adjustment axis when in engagement with said pivot member, said second angle being greater than said first so that movement of said pivot member over said second portion of its range of travel produces a greater change in said bias force per unit travel of said pivot member than does movement of the pivot member over the first portion of its range of travel.

4. A circuit breaker for responding to abnormal currents in a conductor in an electrical system, comprising:

electrical contacts operable between a closed position in which a circuit is completed through the conductor and an open position in which the circuit through the conductor is interrupted;

a latchable operating mechanism operable to open said electrical contacts when unlatched;

a magnetic trip assembly comprising:

a stationary magnetic structure in which a magnetic flux is produced by current in said conductor passing through said electrical contacts;

a movable armature which is attracted to the stationary magnetic structure by said magnetic flux produced by an abnormal current of a selected value through said electrical contacts to unlatch said latchable operating mechanism and open said electrical contacts;

spring means applying a spring biasing force to said armature to bias said armature away from said stationary magnetic structure to form a gap therewith;

spring adjusting means movable over a range of travel adjusting said biasing force to modify the selected value of abnormal current at which said armature is attracted to the fixed magnetic structure to unlatch the latchable operating mechanism, said spring adjusting means providing a first relationship between a movement of the spring adjusting means and change in said biasing force over a first portion of said range of travel of the spring adjusting means and providing a second relationship between movement of the spring adjusting means and change in said biasing force over a second portion of the range of travel of said spring adjusting means; and gap adjusting means adjusting said gap between a minimum spacing and a maximum spacing between said movable armature and said fixed magnetic structure to also modify the selected level of abnormal current at which said movable armature is attracted to the fixed magnetic structure to unlatch the latchable operating mechanism.

5. The circuit breaker of claim 4 including an adjusting member carrying both said spring adjusting means and said gap adjusting means to simultaneously adjust said spring biasing force and said gap.

6. The circuit breaker of claim 5 wherein said gap adjusting means comprises a cam carried by aid adjusting member and having a camming surface against which said movable armature is biased by said spring means to set said gap, said camming surface being shaped to adjust said gap through movement of the adjusting member relative to said armature.

7. The circuit breaker of claim 6 wherein said armature is pivoted about a pivot axis for rotation toward and away from said stationary magnetic structure, wherein said adjusting member is elongated and mounted for generally rectilinear movement along an adjustment axis generally parallel to said pivot axis to provide said range of travel of said spring adjusting means, wherein said spring means is a torsion spring having a first torsion arm which bears against said armature and a second torsion arm having a first portion and a second terminal portion extending at an angle to the first portion, and wherein said spring adjusting means comprises a pivot member mounted on said elongated adjusting member which said second torsion arm engages and slides along as said elongated adjusting member moves rectilinearly, said first portion of said second torsion arm engaging and sliding along aid pivot member for the first portion of the range of travel of the adjusting member and the second terminal portion of said second torsion arm engaging sliding along said pivot member for the second portion of said range of travel of the adjusting member.

8. The circuit breaker of claim 7 wherein the first portion of the second torsion arm of said torsion spring forms a first angle with the adjustment axis of the adjusting member when in engagement with said pivot member and wherein the second portion of the second torsion arm of said torsion spring forms a second angle with said adjustment axis when in engagement with said pivot member, said second angle being greater than said first so that movement of said adjusting member over said second portion of said range of travel produces a greater change in said bias force per unit travel of said adjusting member than does movement of the adjusting member over the first portion of said range of travel.

9. The circuit breaker of claim 8 wherein said camming surface is located on said adjusting member and is shaped to set said gap toward the maximum spacing between the movable armature and the fixed magnetic structure when said second portion of said second torsion arm of the torsion spring engages said pivot member and to set said gap toward said minimum spacing between the movable armature and the fixed magnetic structure when said first portion of said second torsion arm of the torsion spring engages said pivot member.

10. A circuit breaker for responding to abnormal currents in phase conductors associated with each phase of a three phase electrical system comprising:

a set of electrical contacts for each phase conductor of the three phase electrical system completing an electrical circuit through the associated phase conductor when closed and interrupting the electrical circuit when open;

a latchable spring powered operating mechanism operable to open all of said sets of electrical contacts when unlatched;

a trip bar rotatable from a biased position to a trip position to unlatch said operating mechanism;

a magnetic trip assembly associated with each phase conductor of the three phase electric system with each assembly comprising:

a stationary magnetic structure;

a pivotally mounted armature rotatable about a pivot axis toward the stationary magnetic structure to rotate the trip bar to the trip position in response to an abnormal current through the associated phase conductor; and torsion spring means having a first torsion arm biasing said armature away from said stationary magnetic structure to form a gap therebetween and having a second torsion arm with a first portion and a second terminal portion extending at an angle from the first portion of the second torsion arm; and an adjusting member mounted for reciprocal generally rectilinear movement over a range of travel along an adjustment axis generally parallel to the pivot axes of said armatures, said adjusting member carrying a pivot member associated with each torsion spring, the first portion of the second torsion arm of each torsion spring engaging and sliding along the associated pivot member for a first portion of the travel range of said adjusting member and the second terminal portion of said second torsion arm of each torsion spring engaging and sliding along the associated pivot member for a second portion of the range of travel of said adjusting member.

11. A circuit breaker for responding to abnormal currents in phase conductors associated with each phase of a three phase electrical system comprising:

a set of electrical contacts for each phase conductor of the three phase electrical system completing an electrical circuit through the associated phase conductor when closed and interrupting the electrical circuit when open;

a latchable spring powered operating mechanism operable to open all of said sets of electrical contacts when unlatched;

a trip bar rotatable from a biased position to a trip position to unlatch said operating mechanism;

a magnetic trip assembly associated with each phase conductor of the three phase electric system with each assembly comprising:

a stationary magnetic structure;

a pivotally mounted armature rotatable about a pivot axis toward the stationary magnetic structure to rotate the trip bar to the trip position in response to an abnormal current through the associated phase conductor; and torsion spring means having a first torsion arm biasing said armature away from said stationary magnetic structure to form a gap therebetween and having a second torsion arm with a first portion and a second terminal portion extending at an angle from the first portion of the second torsion arm; and an adjusting member mounted for reciprocal generally rectilinear movement over a range of travel along an adjustment axis generally parallel to the pivot axes of said armatures, said adjusting member carrying a pivot member associated with each torsion spring, the first portion of the second torsion arm of each torsion spring engaging and sliding along the associated pivot member for a first portion of the travel range of said adjusting member and the second terminal portion of said second torsion arm of each torsion spring engaging and sliding along the associated pivot member for a second portion of the range of travel of said adjusting member; and a cam associated with each armature mounted on the adjusting member, each cam having a camming surface against which the associated armature is biased by the first torsion arm of the associated torsion spring, said camming surface of each cam having a profile which adjusts the gap between the associated armature and stationary magnetic structure from a maximum adjacent one end of said range of travel of said adjusting member and a minimum adjacent the other end of said range of travel of said adjusting member.

12. The circuit breaker of claim 11 wherein said first portion of the second torsion arm of each torsion spring forms a first angle with the adjustment axis of said adjusting member when said first portion is in engagement with said pivot member, and wherein said second terminal portion of said second torsion arm of said torsion spring forms a second angle with the adjustment axis of said adjusting member when said second portion is in engagement with said pivot member, said second angle being greater than said first angle so that movement of said adjusting member over said second portion of said range of travel produces a greater change in said bias force per unit travel of said adjusting member than does movement of the adjusting member over the first portion of said range of travel.

13. The circuit breaker of claim 12 wherein said second terminal portion of said second torsion arm of the torsion spring engages said pivot member when said adjusting member is adjacent said one end of said range of travel of said adjusting member and wherein said first portion of the second arm of said torsion spring engages said pivot member when said adjusting member is adjacent said other end of said range of travel of said adjusting member such that the greater change in said bias force applied to the armatures per unit travel of said adjusting member occurs with the gaps between the armatures and the stationary magnetic structures near the maximum.

14. A circuit breaker for responding to abnormal currents in phase conductors associated with each phase of a three phase electrical system comprising:

a set of electrical contacts for each phase conductor of the three phase electrical system completing an electrical circuit through the associated phase conductor when closed and interrupting the electrical circuit when open;

a latchable spring powered operating mechanism operable to open all of said sets of electrical contacts when unlatched;

a trip bar rotatable from a biased position to a trip position to unlatch said operating mechanism;

a magnetic trip assembly associated with each phase conductor of the three phase electric system with each assembly comprising:

a stationary magnetic structure;

a pivotally mounted armature rotatable about a pivot axis toward the stationary magnetic structure to rotate the trip bar to the trip position in response to an abnormal current through the associated phase conductor; and torsion spring means having a first torsion arm biasing said armature away from said stationary magnetic structure to form a gap therebetween and having a second torsion arm with a first portion and a second terminal portion extending at an angle from the first portion of the second torsion arm; and an adjusting member mounted for reciprocal generally rectilinear movement over a range of travel along an adjustment axis generally parallel to the pivot axes of said armatures, said adjusting member carrying a pivot member associated with each torsion spring, the first portion of the second torsion arm of each torsion spring engaging and sliding along the associated pivot member for a first portion of the travel range of said adjusting member and the second terminal portion of said second torsion arm of each torsion spring engaging and sliding along the associated pivot member for a second portion of the range of travel of said adjusting member; and said armatures each having an integral camming surface which is inclined to the pivot axis of the armature and wherein said adjusting member has a projection associated with each armature against which the associated armature is biased by a torsion spring to set said gap, said project is sliding along the associated camming surface to adjust said gap as the adjusting member moves generally rectilinearly over said range of travel.

15. The circuit breaker of claim 14 wherein said projections are screws which can be individually threaded toward and away from the associated armature to individually adjust the gap for each phase.

* * * * *